US010533787B2

(12) United States Patent
Song et al.

(10) Patent No.: US 10,533,787 B2
(45) Date of Patent: Jan. 14, 2020

(54) AIR CONDITIONER AND CONTROL METHOD THEREFOR

(71) Applicant: LG ELECTRONICS INC., Seoul (KR)

(72) Inventors: Chiwoo Song, Seoul (KR); Pilhyun Yoon, Seoul (KR); Kakjoong Kim, Seoul (KR); Jaehwa Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/764,113

(22) PCT Filed: Sep. 12, 2016

(86) PCT No.: PCT/KR2016/010302
§ 371 (c)(1),
(2) Date: Mar. 28, 2018

(87) PCT Pub. No.: WO2017/057860
PCT Pub. Date: Apr. 6, 2017

(65) Prior Publication Data

US 2018/0283751 A1 Oct. 4, 2018

(30) Foreign Application Priority Data

Sep. 30, 2015 (KR) ..... 10-2015-0137605

(51) Int. Cl.
*F25B 49/02* (2006.01)
*F25B 47/02* (2006.01)
(Continued)

(52) U.S. Cl.
CPC ..... *F25B 49/02* (2013.01); *F25B 47/022* (2013.01); *F25B 13/00* (2013.01);
(Continued)

(58) Field of Classification Search
CPC ..... F25B 47/022; F25B 47/006; F25B 49/02; F25B 2500/19; F25B 13/00;
(Continued)

(56) References Cited

U.S. PATENT DOCUMENTS 4,914,926 A * 4/1990 Gregory ..... F25B 47/022 62/196.4
5,297,396 A * 3/1994 Kitamoto ..... F24F 3/065 165/11.1
2012/0023989 A1* 2/2012 Kinoshita ..... F24F 11/70 62/186

FOREIGN PATENT DOCUMENTS

JP H 07-293975 11/1995
JP H 09-159329 6/1997
(Continued)

OTHER PUBLICATIONS

Okaza Noriho, JP-4755618-B2, Refrigerating Cycle Device (Year: 2011).*
(Continued)

*Primary Examiner* — Ana M Vazquez
(74) *Attorney, Agent, or Firm* — KED & Associates LLP

(57) ABSTRACT

An air conditioner and a control method for an air conditioner are provided. The air conditioner may include a compressor, a flow switch installed at an outlet side of the compressor, a first guide pipe extending from the flow switch to an outdoor heat exchanger, a second guide pipe extending from the flow switch to an indoor unit, a third guide pipe extending from the outdoor heat exchanger to the indoor unit, a bypass passage extending from the second guide pipe to the third guide pipe to allow at least a portion of the refrigerant in the second guide pipe to be bypassed to the third guide pipe or to allow at least a portion of the
(Continued)

refrigerant in the third guide pipe to be bypassed to the second guide pipe, and a bypass valve installed on the bypass passage.

15 Claims, 9 Drawing Sheets

(51) Int. Cl.
*F25B 13/00* (2006.01)
*F25D 21/06* (2006.01)

(52) U.S. Cl.
CPC ..... *F25B 2400/0409* (2013.01); *F25B 2400/0411* (2013.01); *F25B 2500/19* (2013.01); *F25B 2600/2501* (2013.01); *F25B 2700/151* (2013.01); *F25B 2700/1933* (2013.01); *F25B 2700/2101* (2013.01); *F25D 21/06* (2013.01)

(58) Field of Classification Search
CPC ..... F25B 2700/151; F25B 2700/2101; F25B 2700/1933; F25B 2600/2501; F25D 21/04; F25D 21/06
See application file for complete search history.

(56) References Cited

FOREIGN PATENT DOCUMENTS

| | | |
|---|---|---|
| JP | H 11-37571 | 2/1999 |
| JP | 2009-174800 | 8/2009 |
| JP | 4755618 B2 * | 8/2011 |
| KR | 10-2014-0093846 | 7/2014 |
| KR | 10-2014-0094343 | 7/2014 |

OTHER PUBLICATIONS

International Search Report (with English Translation) and Written Opinion dated Dec. 22, 2016 issued in Application No. PCT/KR2016/010302.

* cited by examiner

AIR CONDITIONER AND CONTROL METHOD THEREFOR

CROSS-REFERENCE TO RELATED PATENT APPLICATIONS

This application is a U.S. National Stage Application under 35 U.S.C. § 371 of PCT Application No. PCT/KR2016/010302, filed Sep. 12, 2016, which claims priority to Korean Patent Application No. 10-2015-0137605, filed Sep. 30, 2015, whose entire disclosures are hereby incorporated by reference.

BACKGROUND

Field

The present invention relates to an air conditioner and a method of controlling the same.

Background

An air conditioner is an apparatus for maintaining the air of a predetermined space in a suitable condition according to usage and purposes thereof. In general, the air conditioner includes a compressor, a condenser, an expansion device and an evaporator, and may cool or heat the predetermined space by performing a refrigeration cycle for performing compression, condensing, expansion and evaporation of refrigerant.

The predetermined space may be changed according to a place where the air conditioner is used. For example, if the air conditioner is disposed in home or office, the predetermined space may be an indoor space of a house or a building. In contrast, when the air conditioner is disposed in a vehicle, the predetermined space may be a boarding space in which a person rides.

When the air conditioner performs a cooling operation, an outdoor heat exchanger provided in an outdoor unit performs a condenser function and an indoor heat exchanger provided in an indoor unit performs an evaporator function. In contrast, when the air conditioner performs a heating operation, the indoor heat exchanger performs a condenser function and the outdoor heat exchanger performs an evaporator function.

Meanwhile, the air conditioner may be configured such that one outdoor unit is connected to one or more indoor units. In order to deal with the load of the one or more indoor units, the capacity of the compressor provided in the outdoor unit tends to be increased.

Even when the outdoor unit including the compressor having large capacity is driven, if the operation load of the indoor unit is low, for example, if only some of a plurality of indoor units are driven or if operation capacity required by the indoor unit is low, the capacity of the compressor becomes relatively excessive and thus a refrigeration cycle is not formed in an appropriate range.

Specifically, when the capacity of the compressor is greater than the load of the indoor unit, the high pressure of the refrigeration cycle is increased to an abnormal region and thus the compressor is frequently turned off. As a result, the compressor is repeatedly turned on/off, thereby restricting continuous operation of the air conditioner.

In addition, in an environment in which an outdoor temperature is in a sub-zero range and outdoor humidity is high, freezing may occur in the outdoor heat exchanger. To this end, a defrosting operation may be performed in the air conditioner. In a process of performing the defrosting operation, defrost water generated in the outdoor heat exchanger is collected in the lower portion of the outdoor heat exchanger and the defrost water is frozen again due to a low outdoor temperature.

By freezing, heat exchange efficiency of the outdoor heat exchanger is lowered and thus operation efficiency of the air conditioner is lowered.

Information on prior art related to this is as follows.

PRIOR ART

1. Korean Unexamined Patent Publication No. 10-2014-0094343 (Publication date: Jul. 30, 2014), 2. Title of the Invention: Air conditioner and method of controlling the same An object of the present invention is to provide an air conditioner capable of performing stable operation in consideration of the load of a compressor and the load of an indoor unit, and a method of controlling the same.

Another object of the present invention is to provide an air conditioner capable of preventing freezing from occurring in a lower portion of an outdoor unit upon a heating operation.

The object of the present invention can be achieved by providing an air conditioner including a compressor for compressing refrigerant, a flow switching unit or flow switch installed at an outlet side of the compressor, a first guide pipe extending from the flow switching unit to an outdoor heat exchanger, a second guide pipe extending from the flow switching unit to an indoor unit, a third guide pipe extending from the outdoor heat exchanger to the indoor unit, a bypass flow passage extending from the second guide pipe to the third guide pipe such that at least some of the refrigerant of the second guide pipe is bypassed to the third guide pipe or at least some of the refrigerant of the third guide pipe is bypassed to the second guide pipe, and a bypass valve installed in the bypass flow passage to adjust the amount of refrigerant flowing through the bypass flow passage.

The air conditioner may further include a compressor load sensing unit or sensor for sensing a load of the compressor and an indoor-unit load sensing unit or sensor for sensing a load of the indoor unit.

An opening degree of the bypass valve may be adjusted based on first information recognized in the compressor load sensing unit and second information recognized in the indoor-unit load sensing unit.

The outdoor heat exchanger may include a first heat exchanging part or portion forming an upper portion of the outdoor heat exchanger and connected to the first guide pipe and a second heat exchanging part or portion disposed below the first heat exchanging part.

The air conditioner may further include an outdoor fan installed at an upper side of the outdoor heat exchanger to flow outdoor air to the outdoor heat exchanger.

The bypass flow passage may include the second heat exchanging part.

The air conditioner may further include a bypass temperature sensor installed in the bypass flow passage to sense a temperature of refrigerant passing through the bypass flow passage and a low-pressure sensor for sensing low pressure of refrigerant sucked into the compressor.

The opening degree of the bypass valve may be adjusted based on a degree of superheat or superheating degree recognized based on information sensed by the bypass temperature sensor and the low-pressure sensor.

The air conditioner may further include a main expansion device installed in the third guide pipe and an indoor expansion device installed in the indoor unit.

During a cooling operation of the air conditioner, the flow switching unit may perform a first operation mode and the bypass valve may be opened at a set or predetermined opening degree, such that refrigerant passing through the first heat exchanging part of the outdoor heat exchanger is guided to the second heat exchanging part.

During a heating operation of the air conditioner, the flow switching unit may perform a second operation mode and the bypass valve may be opened at a set or predetermined opening degree, such that at least some of refrigerant of the second guide pipe is guided to the second heat exchanging part.

According to another aspect of the present invention, a method of controlling an air conditioner includes driving a compressor to perform a cooling operation or a heating operation, enabling refrigerant to flow to an outdoor heat exchanger or an indoor unit according to an operation mode of a flow switching unit or flow switch installed at an outlet side of the compressor, controlling an opening degree of a bypass valve such that at least some of refrigerant passing a first heat exchanging part or portion of the outdoor heat exchanger or refrigerant to be introduced into the indoor unit flows to a bypass flow passage, and sensing an operation load of the compressor and an operation load of the indoor unit to adjust the opening degree of the bypass valve. The bypass flow passage extends from a second guide pipe extending from the flow switching unit to the indoor unit to a third guide pipe extending from the outdoor heat exchanger to the indoor unit.

When the operation load of the compressor is greater than that of the indoor unit by a set or predetermined value, the opening degree of the bypass valve may be increased, and, when a difference between the operation load of the compressor and the operation load of the indoor unit is equal to or less than the set or predetermined value, the opening degree of the bypass valve may be maintained or decreased.

The method may further include, during a cooling operation of the air conditioner, sensing a temperature of refrigerant passing through the bypass flow passage and low pressure of refrigerant sucked into the compressor to recognize a degree of superheat of refrigerant passing through the bypass flow passage.

When the degree of superheat is lower than a target degree of superheat, the opening degree of the bypass value may be decreased, and, when the degree of superheat is higher than the target degree of superheat, the opening degree of the bypass value may be increased.

The method may further include, during a heating operation of the air conditioner, sensing an outdoor air temperature and outdoor air humidity to adjust the opening degree of the bypass valve.

The outdoor heat exchanger may further include a second heat exchanging part or portion located below the first heat exchanging part, and the bypass flow passage may be connected to the second heat exchanging part.

According to the embodiments of the present invention, upon recognizing that the load of a compressor is relatively greater than that of an indoor unit, since some of the refrigerant to be introduced into the indoor unit is bypassed to the suction side of the compressor, balance between the load of the compressor and the load of the indoor unit can be achieved and thus a refrigeration cycle can be stably performed.

In addition, since a bypass valve having an adjustable opening degree is installed in a bypass flow passage for guiding flow of bypassed refrigerant and the opening degree of the bypass valve is adjusted based on the loads of the compressor and the indoor unit, it is possible to efficiently control the amount of bypassed refrigerant.

In addition, since the heat exchanging part or portion of an outdoor heat exchanger is configured to be included in the bypass flow passage, it is not necessary to provide a separate bypass pipe and it is possible to increase space utilization of the outdoor unit having a limited space.

In addition, since the degree of superheat of the bypassed refrigerant is sensed during a cooling operation of the air conditioner and the amount of bypassed refrigerant is adjusted based on the sensed degree of superheat, it is possible to prevent a phenomenon wherein liquid refrigerant is accumulated in a gas-liquid separator due to an insufficient degree of superheat to cause a shortage of refrigerant in a system.

In addition, since high-pressure refrigerant discharged from the compressor is bypassed to the heat exchanging part of the outdoor heat exchanger during a heating operation of the air conditioner, it is possible to prevent freezing from occurring in the outdoor heat exchanger.

In particular, since the bypass flow passage includes the lower heat exchanging part of an outdoor heat exchanger having a relatively small heat exchange amount among all outdoor heat exchangers, even if refrigerant is bypassed through the lower heat exchanging part, it is possible to efficiently prevent freezing from occurring in the outdoor heat exchanger while reducing the heat exchange capacity of the outdoor heat exchanger.

DETAILED DESCRIPTION

Hereinafter, the embodiments of the present invention will be described with reference to the accompanying drawings. The scope of the present invention is not limited to the embodiments and those skilled in the art may readily propose other embodiments within the range of the same idea.

Figure 1:
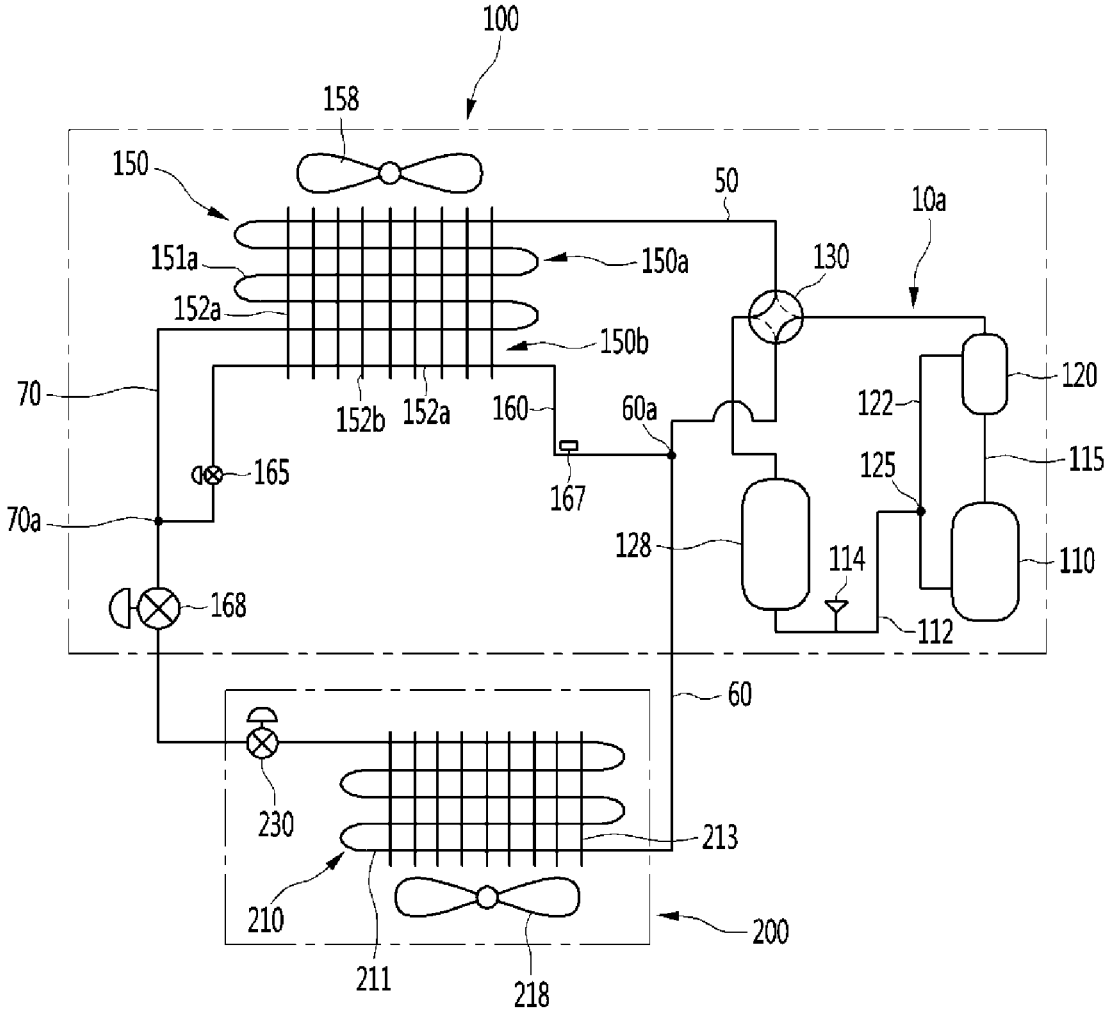
FIG. 1 is a diagram showing the configuration of an air conditioner according to an embodiment of the present invention.
Figure 2:
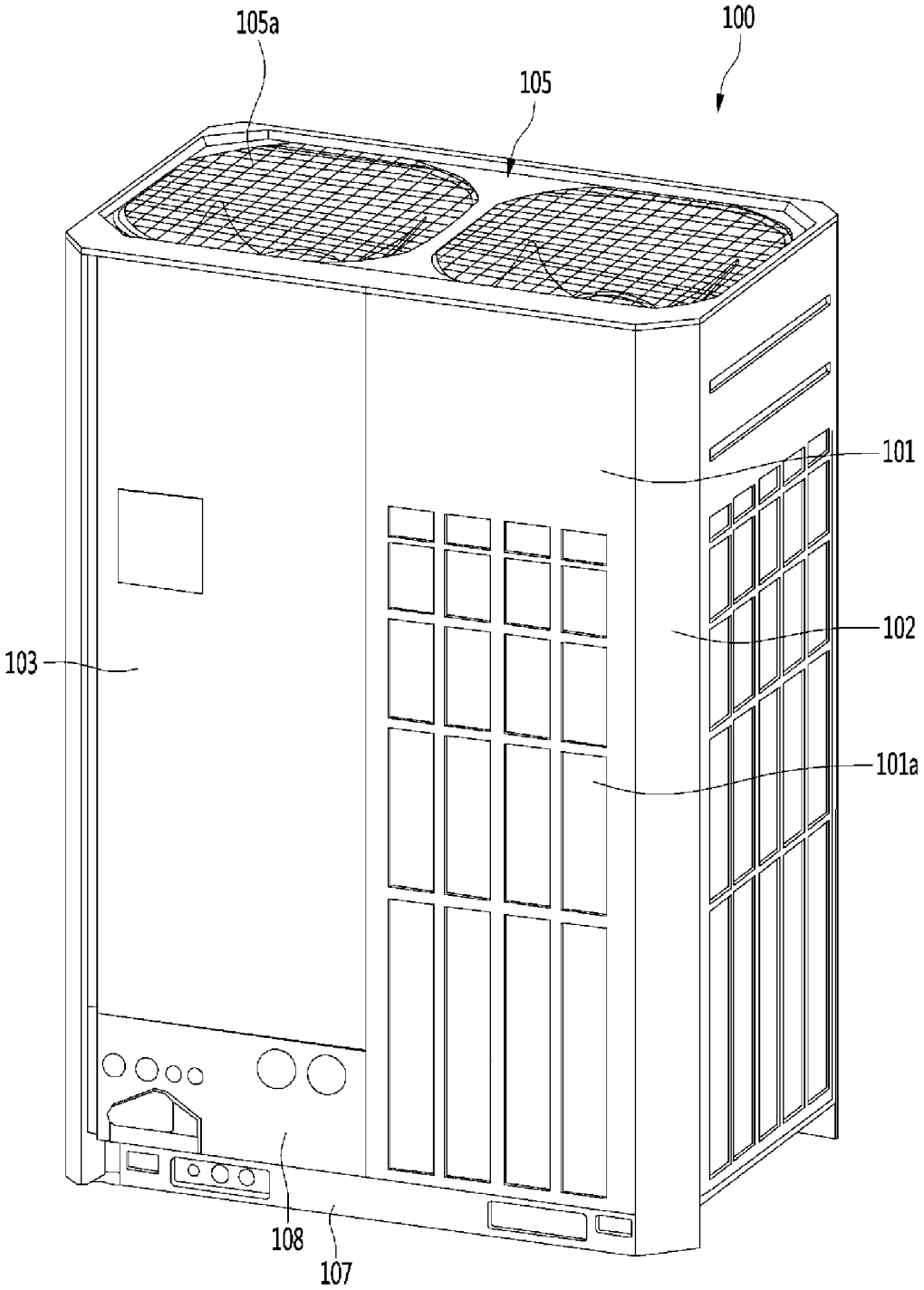
FIG. 2 is a perspective view showing the configuration of an outdoor unit of an air conditioner according to an embodiment of the present invention.
Figure 3:
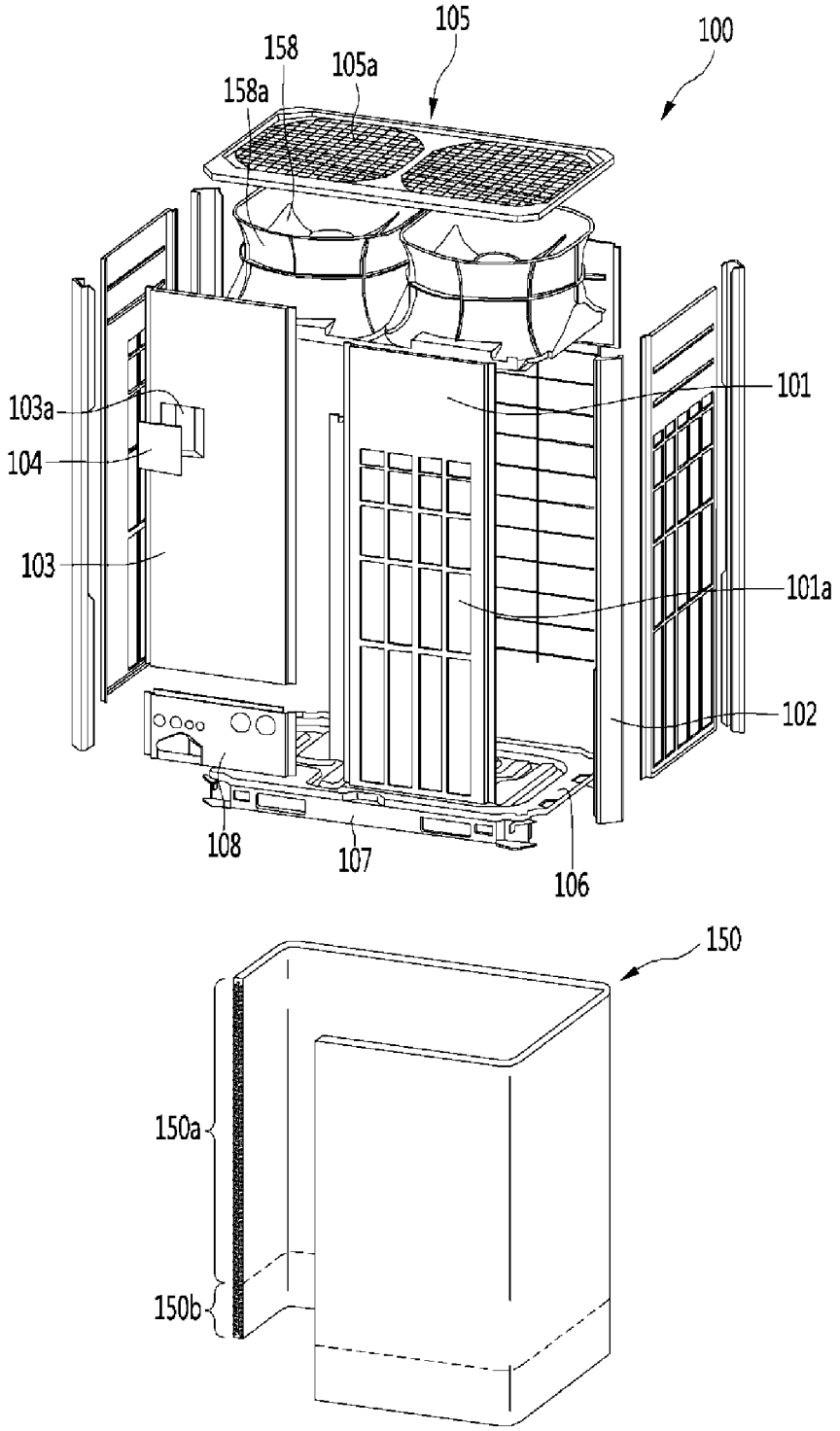
FIG. 3 is an exploded perspective view showing the configuration of an outdoor unit of an air conditioner according to an embodiment of the present invention.

FIG. 1 is a diagram showing the configuration of an air conditioner according to an embodiment of the present invention, FIG. 2 is a perspective view showing the configuration of an outdoor unit of an air conditioner according to an embodiment of the present invention, and FIG. 3 is an exploded perspective view showing the configuration of an outdoor unit of an air conditioner according to an embodiment of the present invention.

The air conditioner 100 according to the embodiment of the present invention includes an outdoor unit 100 and an indoor unit 200. The indoor unit 200 may include one or more indoor units. Although one indoor unit is shown in FIG. 1, a plurality of indoor units may be connected in parallel.

The air conditioner 10 further includes a refrigerant tube 10*a* for connecting a plurality of parts provided in the outdoor unit 100 and a plurality of parts configuring the indoor unit 200 to guide flow of refrigerant.

Referring to FIG. 2 and FIG. 3, the outdoor unit 100 includes a base 106 forming a lower appearance of the outdoor unit and supporting the plurality of parts disposed in the outdoor unit, legs 107 disposed at the lower side of the base 106 to support the outdoor unit 100 at an installation place, and cabinets 101, 102 and 103 provided at an upper side of the base 106.

The legs 107 may be installed at lower portions of both sides of the base 106 and may be placed at the installation place, for example, on the ground. The base 106 has a shape of a plate including two long-side portions and two short-side portions, and the legs 107 may be installed at the lower sides of the two long-side portions of the base 106. For example, the base 106 may have a rectangular shape.

The cabinets 101, 102 and 103 include suction panels 101. A plurality of suction panels 101 is installed along the circumference of the base 106.

For example, four suction panels 101 are provided and installed at front and rear sides and left and right sides of the base 106. The plurality of suction panels 101 includes a suction grille 101*a* for allowing outdoor air to flow into the outdoor unit 10. Outdoor air may be introduced from the front and rear sides or the left and right sides of the outdoor unit 100 into the outdoor unit 100 through the plurality of suction panels 101.

The cabinets 101, 102 and 103 further include a control panel 103. The control panel 103 may be understood as an openable door for accessing a control box (not shown) installed in the outdoor unit 100. For example, the control panel 103 may be rotatably or slidably provided.

The cabinets 101, 102 and 103 further include a service panel 108 installed at the lower side of the control panel 103. For manipulation of a service valve assembly or replacement or welding of a refrigerant pipe, the service panel 108 may be detached from the outdoor unit 100.

The control panel 103 and the service panel 108 may be installed at the side of the suction panel 101 provided at the front side of the outdoor unit 100 among the plurality of suction panels 101.

The control panel 103 includes a viewing window 103*a*, through which the display of the control box may be viewed, and a cover member 104 for selectively opening the viewing window 103*a*.

The cabinets 101, 102 and 103 further include brackets 102 supporting the plurality of suction panels 101 and the control panel 103. A plurality of brackets or side panels 102 may be provided and be extended from the base 106 upward. In addition, one of the plurality of brackets 102 may be disposed between one suction panel and anther suction panel. The other brackets may be disposed between one suction panel and the control panel 103.

An outdoor heat exchanger 150 may be installed in the outdoor unit 100. The outdoor heat exchanger 150 may be extended along the inner side surfaces of the cabinets 101, 102 and 103 and may be seated on the upper surface of the base 106.

In other words, the outdoor heat exchanger 150 may be bent multiple times and may be extended along the inner side surfaces of the plurality of suction panels 102. The outdoor heat exchanger 150 may be seated in a rim forming the long side of the base 106 and a rim forming a short side of the base.

For example, the outdoor heat exchanger 150 may be bent three times and may have four surfaces. The four surfaces may be disposed to face the four suction panels.

The outdoor heat exchanger 150 includes a first heat exchanging part or portion 150*a* forming the upper portion of the outdoor heat exchanger 150 and connected to a first guide pipe 50 and a second heat exchanging part or portion 150*b* located below the first heat exchanging part 150*a* to form the lower portion of the outdoor heat exchanger 150.

The first heat exchanging part 150*a* includes a first heat exchanging pipe 151*a*, through which refrigerant flows, and a first fin 151*b* coupled to the first heat exchanging pipe 151*a* to facilitate heat exchange of refrigerant. The second heat exchanging part 150*b* includes a second heat exchanging pipe 152*a*, through which refrigerant flows, and a second fin 152*b* coupled to the second heat exchanging pipe 152*a* to facilitate heat exchange of refrigerant.

The first and second heat exchange pipes 151*a* and 152*a* configure or make at least a part of the refrigerant pipe 100 of the air conditioner 10, and the first and second fins 151*b* and 152*b* provide heat exchange surfaces of refrigerant and air. Outdoor air introduced through the suction grille 101*a* of the plurality of suction panels 101 may be heat exchanged while passing through the outdoor heat exchanger 150.

Heat exchange capacity of the first heat exchanging part 150*a* may be greater than that of the second heat exchanging part 150*b*. That is, the length or capacity of the first heat exchanging pipe 151*a* and the first fin 151*b* may be greater than that of the second heat exchanging pipe 152*a* and the second fin 152*b*.

The outdoor unit 100 includes an outdoor fan 158 for introducing outdoor air and a fan housing 158*a* disposed to surround the outdoor fan 158 to guide flow of air. The outdoor unit 100 further includes a discharge panel 105 provided at one side of the outdoor fan 158. The discharge panel 105 includes a discharge grille 105*a* for discharging air to the outside of the outdoor unit 100.

The outdoor fan 158 may be provided at the upper portion of the outdoor unit 100 to flow outdoor air to the outdoor heat exchanger 150 and the discharge panel 105 may be installed above the outdoor fan 158. Air passing through the outdoor heat exchanger 150 flows upward to be discharged from the outdoor unit 100 through the outdoor fan 140 and the discharge panel 105.

Since the discharge panel 105 is located above the outdoor fan 158, outdoor air introduced from the suction grille 101*a* of the suction panel 101 forming four sides may be discharged to the upper portion of the outdoor unit 100 through the outdoor heat exchanger 150 having four sides. Accordingly, heat exchange capacity of the outdoor heat exchanger 150 can be improved.

In the outdoor unit 100, a plurality of parts installed at the upper side of the base 106 may be installed. Specifically, referring to FIG. 1, the plurality of parts includes a compressor 110 for compressing refrigerant. The compressor 110 includes an inverter compressor capable of adjusting cooling power according to control of a driving frequency.

The outdoor unit 100 further includes an oil separator 120 installed in the discharge pipe 115 for guiding the refrigerant discharged from the compressor 110 to separate oil included in the refrigerant.

The outdoor unit 100 further includes a gas-liquid separator 128 installed in the suction pipe 112 for guiding suction of refrigerant to the compressor 110 to separate gas-phase refrigerant from refrigerant and to supply the gas-phase refrigerant to the compressor 110. In the suction pipe 112, a low-pressure sensor 114 for sensing pressure of the refrigerant sucked into the compressor 110 may be installed.

The outdoor unit 100 further includes an oil collection pipe 122 for collecting oil separated by the oil separator 120 to the compressor 110. The oil collection pipe 122 may be connected to one point of the suction pipe 112, that is, a combination part or connector 125. Accordingly, oil collected through the oil collection pipe 122 may be combined with the refrigerant sucked into the compressor 110 through the suction pipe 112, thereby being sucked into the compressor 110.

The outdoor unit 110 further includes a flow switching unit or flow switch 130 provided at the discharge side of the oil separator 120 and controlled to guide the refrigerant discharged from the compressor 110 or the refrigerant passing through the oil separator 120 to the outdoor heat exchanger 150 or the indoor unit 200. For example, the flow switching unit 130 may include a four-way valve.

The air conditioner 10 further includes a first guide pipe 50 extending from the flow switching unit 130 to the outdoor heat exchanger 150 and a second guide pipe 60 extending from the flow switching unit 130 to the indoor unit 200 or the indoor heat exchanger 210.

The first guide pipe 50 may be connected to the first heat exchanging part 150*a* of the outdoor heat exchanger 150.

When the air conditioner 10 operates in a cooling operation mode, the flow switching unit 130 is controlled in a first operation mode such that refrigerant flows to the outdoor heat exchanger 150 through the first guide pipe 50. In contrast, when the air conditioner 10 operates in a heating operation mode, the flow switching unit 130 is controlled in a second operation mode such that refrigerant flows to the indoor unit 200 through the second guide pipe 60.

The outdoor heat exchanger 150 includes a first heat exchanging part 150*a* configuring the upper portion of the outdoor heat exchanger 150 and a second heat exchanging part 150*b* configuring the lower portion of the outdoor heat exchanger. As described above, the first heat exchanging part 150*a* includes a first heat exchange pipe 151*a* and a first fin 151*b*, and the second heat exchanging part 150*b* includes a second heat exchange pipe 152*a* and a second fin 152*b*.

The first heat exchange pipe 151*a* and the second heat exchange pipe 152*a* configure a refrigerant flow path. That is, the refrigerant of the first heat exchange pipe 151*a* and the refrigerant of the second heat exchange pipe 152*a* are not mixed in the outdoor heat exchanger 150.

The first fin 151*a* and the second fin 151*b* may be integrally configured and may be extended from the first heat exchanging part 150*a* to the second heat exchanging part 150*b* in a vertical direction.

The outdoor fan 158 may be installed above the outdoor heat exchanger 150.

The outdoor unit 100 further includes a third guide pipe 70 extending from the outdoor heat exchanger 150 to the indoor unit 200. That is, the guide pipe 70 is understood as a pipe for connecting the outdoor heat exchanger 150 and the indoor unit 200.

When the air conditioner 10 operates in the cooling operation mode, the refrigerant condensed in the outdoor heat exchanger 150 may be introduced into the indoor unit 200 through the third guide pipe 70. In contrast, when the air conditioner 10 operates in the heating operation mode, the refrigerant condensed in the indoor unit 200 may be introduced into the outdoor heat exchanger 150 through the third guide pipe 70.

The outdoor unit 100 further includes a main expansion device 168 installed in the third guide pipe 70 to depressurize refrigerant or to adjust the flow rate of refrigerant. For example, the main expansion device 168 may include an electronic expansion valve (EEV) capable of adjusting an opening degree thereof. When the air conditioner 10 operates in the heating operation mode, the refrigerant condensed in the indoor unit 200 may be depressurized in the main expansion device 168 and introduced into the outdoor heat exchanger 150.

The indoor unit 200 includes an indoor expansion device 230 installed in the third guide pipe 70 to depressurize refrigerant or to adjust the flow rate of refrigerant. For example, the indoor expansion device 230 may include an electronic expansion valve (EEV) capable of adjusting an opening degree thereof. When the air conditioner 10 operates in the cooling operation mode, the refrigerant condensed in the outdoor heat exchanger 150 may be depressurized in the indoor expansion device 230 and introduced into the indoor heat exchanger 210.

The indoor unit 200 further includes the indoor heat exchanger 210 for performing heat exchange with indoor air. The indoor heat exchanger 210 includes an indoor heat exchange pipe 211 for guiding flow of refrigerant and an indoor heat exchange fin 213 coupled to the indoor heat exchange pipe 211. The indoor heat exchanger 210 may function as an evaporator in the cooling operation mode of the air conditioner 10 and function as a condenser in the heating operation mode of the air conditioner 10.

The indoor unit 200 further includes an indoor fan 218 installed at one side of the indoor heat exchanger 210 to enable air to flow.

The air conditioner 10 further include a bypass flow passage 160 for guiding bypass of refrigerant from any one guide pipe of the second and third guide pipes 60 and 70 to the other guide pipe.

The second guide pipe 60 includes a first branch part 60*a*, to which one end of the bypass flow passage 160 is connected. The third guide pipe 70 includes a second branch part 70*a*, to which the other end of the bypass flow passage 160 is connected.

The bypass flow passage 160 includes the second heat exchanging part 150*b* of the outdoor heat exchanger 150. From another viewpoint, the bypass flow passage 160 may be connected with the second heat exchanging part 150*b*. Accordingly, refrigerant passes through the second heat exchanging part 150*b* of the outdoor heat exchanger 150 while refrigerant flows through the bypass flow passage 160.

The bypass flow passage 160 may be provided with a bypass valve 165 capable of controlling the amount of refrigerant flowing through the bypass flow passage 160. For example, the bypass valve 165 may include an EEV capable of adjusting an opening degree thereof. Refrigerant may expand while passing through the bypass valve 165.

The bypass flow passage 160 may be provided with a bypass temperature sensor 167 capable of sensing the temperature of the refrigerant passing through the second heat exchanging part 150*b* in the cooling operation mode of the air conditioner 10.

A saturation temperature (first temperature value) may be calculated or estimated from pressure sensed by the low-pressure sensor 114. A second temperature value may be sensed by the bypass temperature sensor 167. The degree of superheat or superheating degree of the refrigerant flowing through the bypass flow passage 160 may be recognized from a difference between the second temperature value and the first temperature value.

Figure 4:
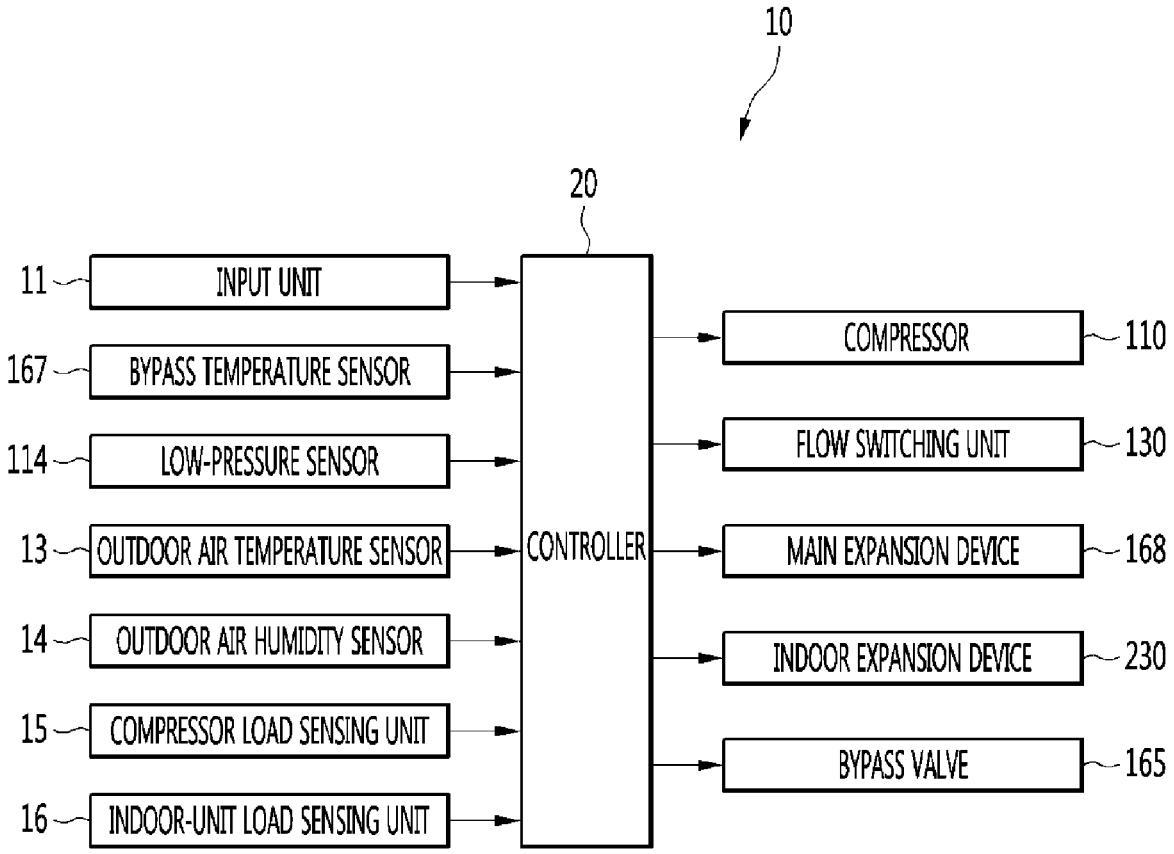
FIG. 4 is a block diagram showing the configuration of an air conditioner according to an embodiment of the present invention.

FIG. 4 is a block diagram showing the configuration of an air conditioner according to an embodiment of the present invention.

Referring to FIG. 4, the air conditioner 10 according to the embodiment of the present invention includes an input unit 11 for inputting a command related to operation of the air conditioner 10. The input unit 11 may include a driving input unit for inputting the driving command of the air conditioner 10 and a mode input unit for inputting a command related to an operation mode.

The air conditioner 10 further includes sensors 114 and 167 for calculating the degree of supercooling or supercooling degree of the refrigerant flowing through the bypass flow passage 160 in the cooling operation of the air conditioner. The sensors 114 and 167 include the low-pressure sensor 114 for sensing the low pressure of a system and the bypass temperature sensor 167 for sensing the temperature of the refrigerant of the bypass flow passage 160.

The air conditioner 10 further includes an outdoor air temperature sensor 13 for sensing an outdoor air temperature and an outdoor air humidity sensor 14 for sensing outdoor air humidity. Based on the values sensed by the outdoor air temperature sensor 13 and the outdoor air humidity sensor 14, a freezing prevention mode may be performed during the heating operation of the outdoor unit 10.

The air conditioner 10 further includes a compressor load sensing unit or sensor 15 for sensing the load of the compressor 110 and an indoor-unit load sensing unit or sensor 16 for sensing the load of the indoor unit 200. The compressor load sensing unit 15 may recognize the driving frequency of the compressor 110. The indoor-unit load sensing unit 16 may recognize the number of operating indoor units among the plurality of indoor units or the heating or cooling load of the indoor unit 200.

For example, the heating or cooling load of the indoor unit 200 may be determined based on a set temperature as compared to the outdoor air temperature. If a difference between the outdoor air temperature and the set temperature is large, it may be recognized that the heating or cooling load of the indoor unit 200 is being large.

The air conditioner 10 further includes a controller 20 for controlling operation of the compressor 110, the flow switching unit 130, the main expansion device 168, the indoor expansion device 230 or the bypass valve 165 based on the signals received from the input unit 11, the bypass temperature sensor 167, the low-pressure sensor 114, the outdoor air temperature sensor 13, the outdoor air humidity sensor 14, the compressor load sensing unit 15 or the indoor-unit load sensing unit 16.

Figure 5:
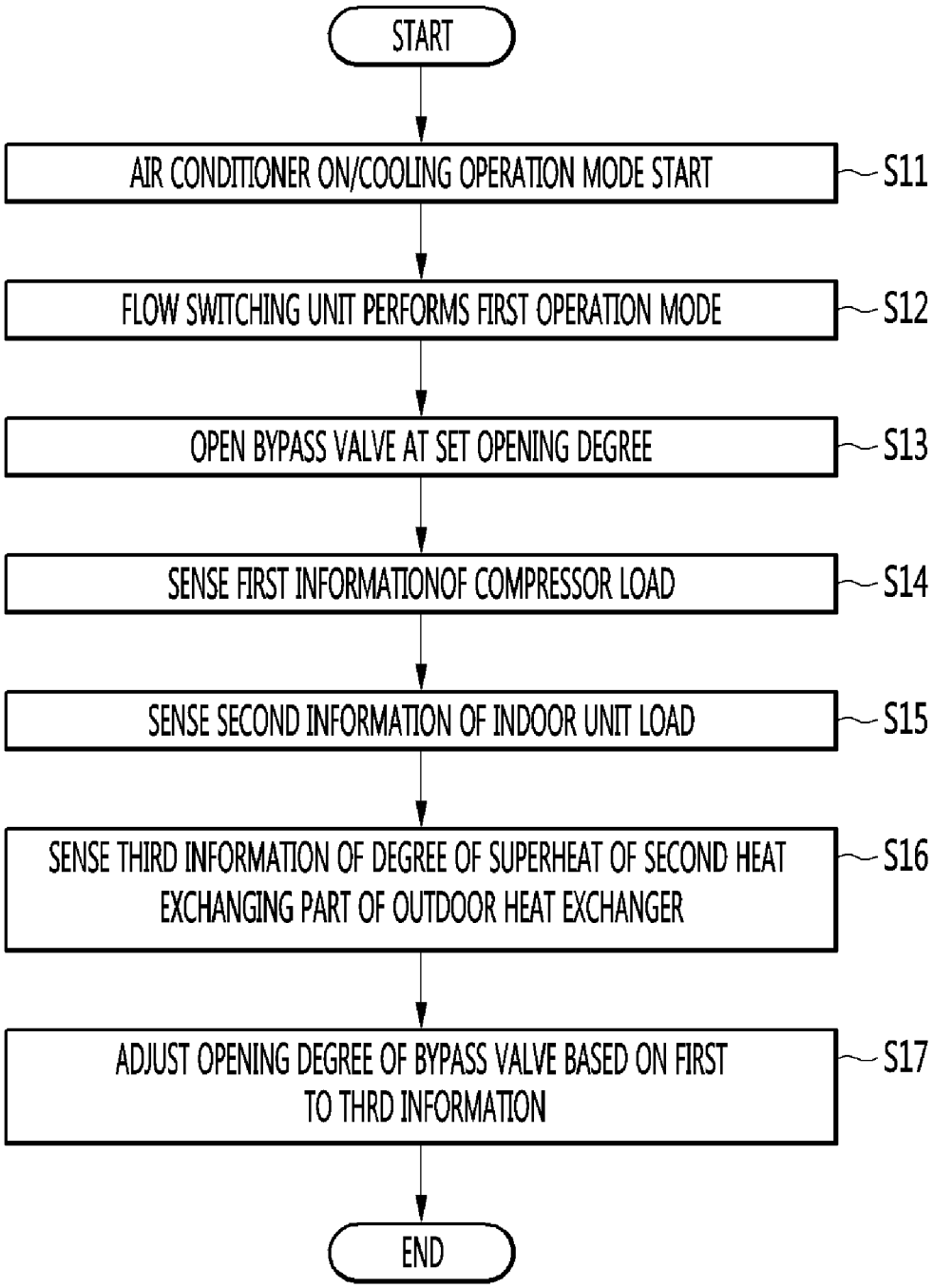
FIG. 5 is a flowchart illustrating a method of controlling an air conditioner during a cooling operation according to an embodiment of the present invention.
Figure 6:
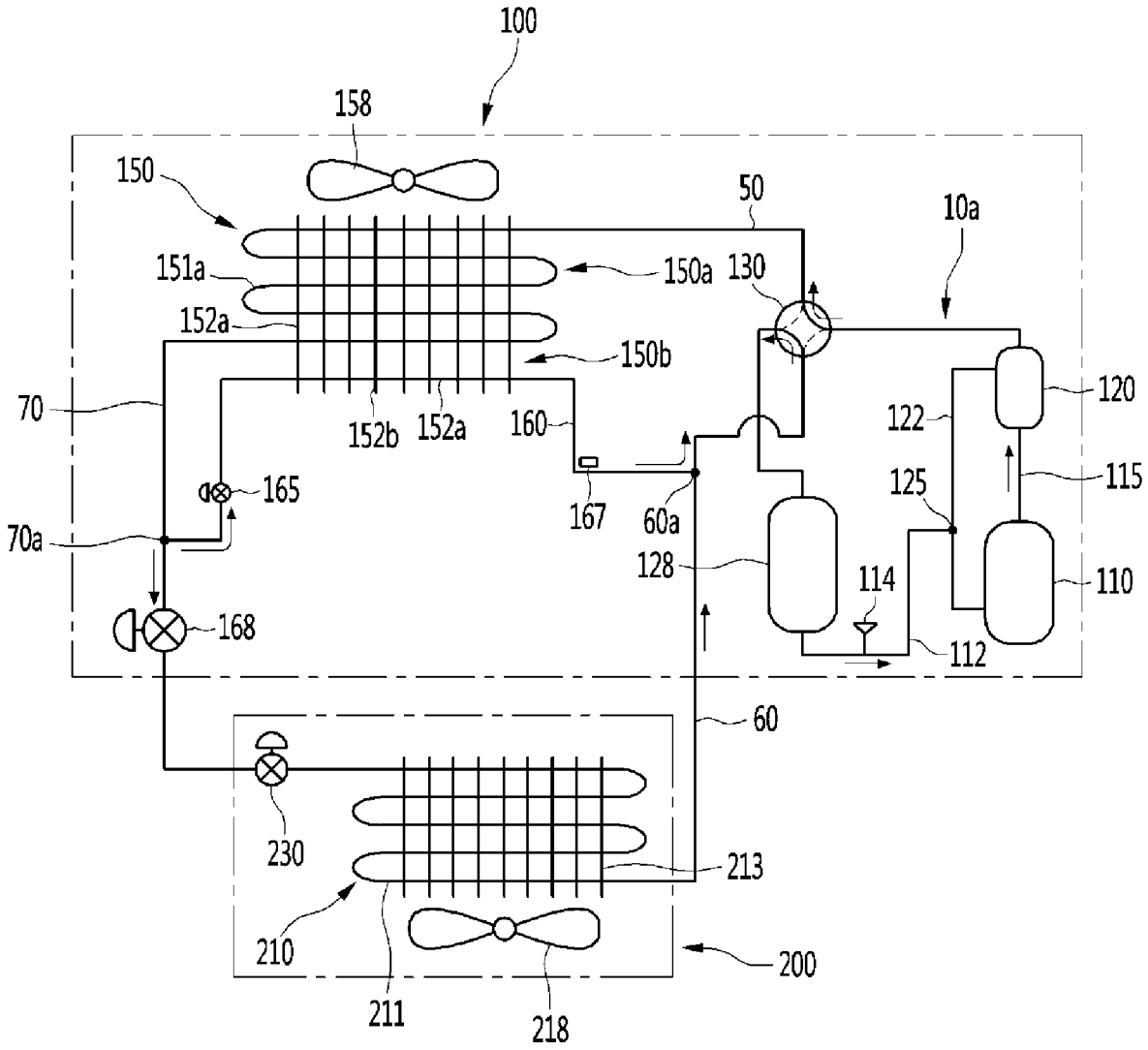
FIG. 6 is a diagram showing flow of refrigerant during a cooling operation of an air conditioner according to an embodiment of the present invention.

FIG. 5 is a flowchart illustrating a method of controlling an air conditioner during a cooling operation according to an embodiment of the present invention, and FIG. 6 is a diagram showing flow of refrigerant during a cooling operation of an air conditioner according to an embodiment of the present invention.

A control method during a cooling operation of an air conditioner of the present invention and flow of refrigerant will be described with reference to FIGS. 5 and 6.

When a cooling operation command of the air conditioner 10 is input through the input unit 11, the air conditioner 10 starts the cooling operation mode (S11).

The flow switching unit 130 performs a first operation mode (S12). As the first operation mode of the flow switching unit 130 is performed, refrigerant compressed by the compressor 110 and passing through the oil separator 120 flows from the flow switching unit 130 to the first guide pipe 50.

The refrigerant of the first guide pipe 50 is introduced into the first heat exchanging part 150*a* of the outdoor heat exchanger 150 to perform heat exchange with outdoor air, and introduction of refrigerant into the second heat exchanging part 150*b* is limited. The refrigerant condensed in the first heat exchanging part 150*a* flows through the third guide pipe 70.

The bypass valve 165 is opened at a predetermined opening degree (S13). As the bypass valve 165 is opened, some of the refrigerant flowing through the third guide pipe 70 is introduced from the second branch part 70*a* to the bypass flow passage 160 and the remaining refrigerant flows into the indoor unit 200. The refrigerant of the bypass flow passage 160 passes through the second heat exchanging part 150*b* of the outdoor heat exchanger 150 and flows into the first branch part 60*a* of the second guide pipe 60.

At this time, a first set of information, or first information, of the operation load of the compressor 110, that is, the driving frequency, is sensed through the compressor load sensing unit 15. In addition, a second set of information, or second information, of the operation load of the indoor unit 200, that is, the cooling load, is sensed through the indoor-unit load sensing unit 16. Therefore, the controller 20 may recognize a difference between the operation capacity of the compressor 110 and the capacity required by the indoor unit 200 (S14 and S15).

A third set of information, or third information, of a degree of superheat of the refrigerant passing through the bypass flow passage 160, that is, the refrigerant passing through the second heat exchanging part 150*b* of the outdoor heat exchanger 150, may be sensed (S16).

Based on the first to third information, the opening degree of the bypass valve 165 may be adjusted.

Specifically, based on the first and second information, the opening degree of the bypass valve 165 may be increased or decreased. For example, if a difference between the first and second information is large, that is, if the operation load of the compressor 110 is greater than that of the indoor unit 200 by a set or predetermined value or more, control may be performed to increase the opening degree of the bypass valve 165. In contrast, if the difference between the first and second information is equal to or less than the set or predetermined value, control may be performed to maintain or decrease the opening degree of the bypass valve 165.

According to such control, a balance between capacity of the compressor 110 and the load of the indoor unit 200 is achieved, thereby performing continuous cooling operation of the air conditioner 10 and preventing the compressor from being frequently turned on/off.

Based on the first and second information, the opening degree of the bypass valve 165 may be adjusted and, after a set or predetermined amount of time has passed, the third information may be sensed. When the third information is within a range of a target degree of superheat, the opening degree of the bypass valve 165 is not further adjusted.

In contrast, if the third information is outside the range of the target degree of superheat, the opening degree of the bypass valve 165 may be adjusted. More specifically, if the third information is less than the target degree of superheat, the opening degree of the bypass valve 165 may be decreased in order to increase the degree of superheat. If the third information is greater than the target degree of superheat, the opening degree of the bypass valve 165 may be increased in order to decrease the degree of superheat.

By controlling the degree of superheat of the refrigerant passing through the bypass flow passage 160 to fall within the range of the degree of superheat, it is possible to prevent liquid refrigerant from being introduced into the gas-liquid separator 128 through the bypass flow passage 160. By preventing the liquid refrigerant from being introduced, it is possible to prevent a phenomenon wherein the liquid refrigerant is accumulated in the gas-liquid separator 128 to cause refrigerant shortage in the refrigeration cycle.

In the above embodiment, after the opening degree of the bypass valve 165 is adjusted according to the first and second information, whether the opening degree of the bypass valve 165 is further adjusted is determined according to the third information. However, whether the opening degree of the bypass valve 165 is further adjusted is determined according to the first and second information after the opening degree of the bypass valve 165 is adjusted according to the third information or the opening degree of the bypass valve 165 may be adjusted according to the first to third information (S17).

Meanwhile, the refrigerant flowing through the third guide pipe 70 is introduced into the indoor unit 200, is expanded in the indoor expansion device 230, and is evaporated while passing through the indoor heat exchanger 210.

The refrigerant evaporated in the indoor unit 200 flows through the second guide pipe 60 and is combined with the refrigerant flowing through the bypass flow passage 160. The combined refrigerant is introduced into the flow switching unit 130 and is introduced from the flow switching unit 130 to the gas-liquid separator 128. The gas-phase refrigerant separated in the gas-liquid separator 128 may be sucked and compressed in the compressor 110 through the suction pipe 112.

Figure 7:
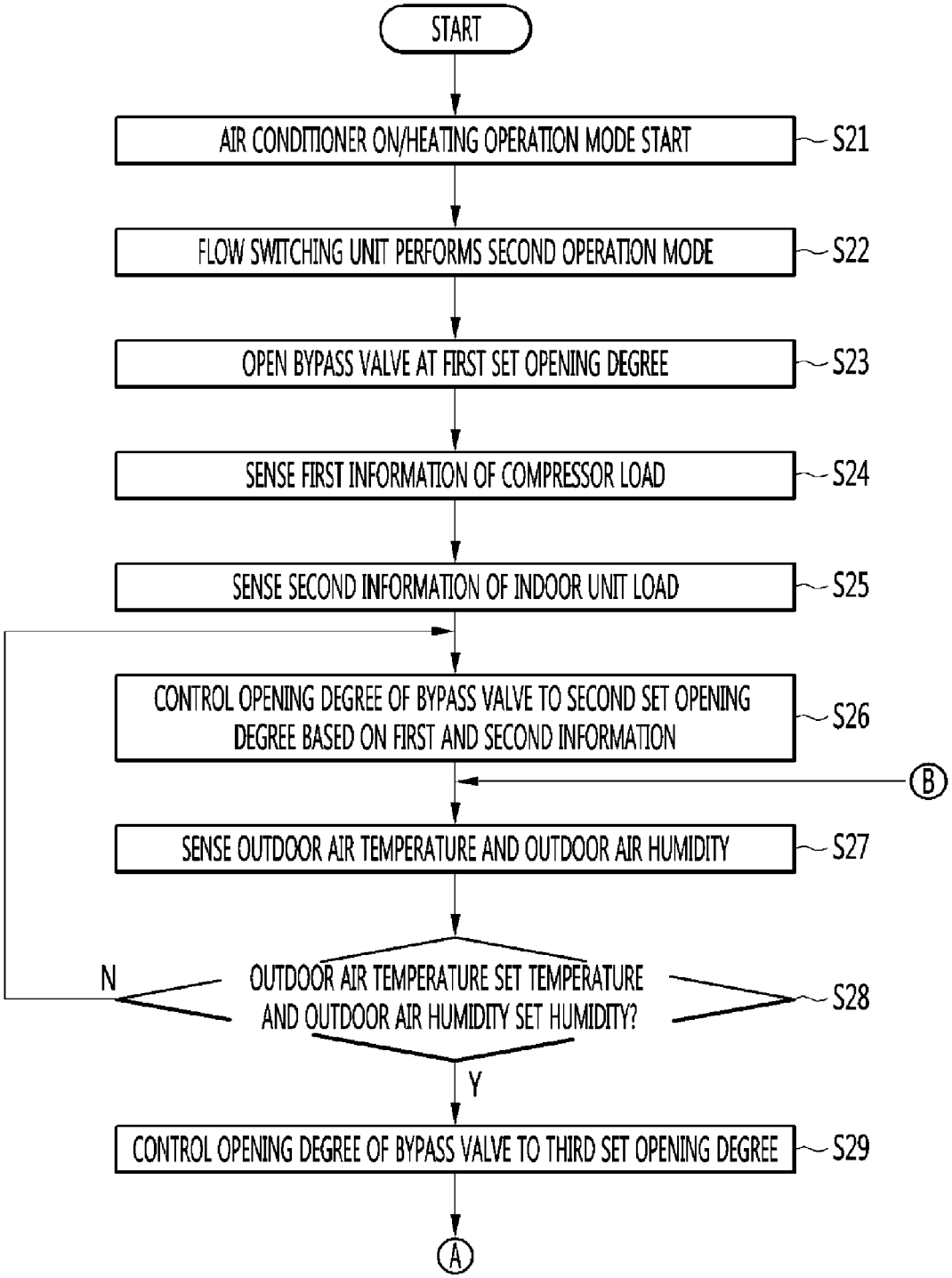
FIG. 7 and FIG. 8 are flowcharts illustrating methods of controlling an air conditioner during a heating operation according to an embodiment of the present invention.
Figure 8:
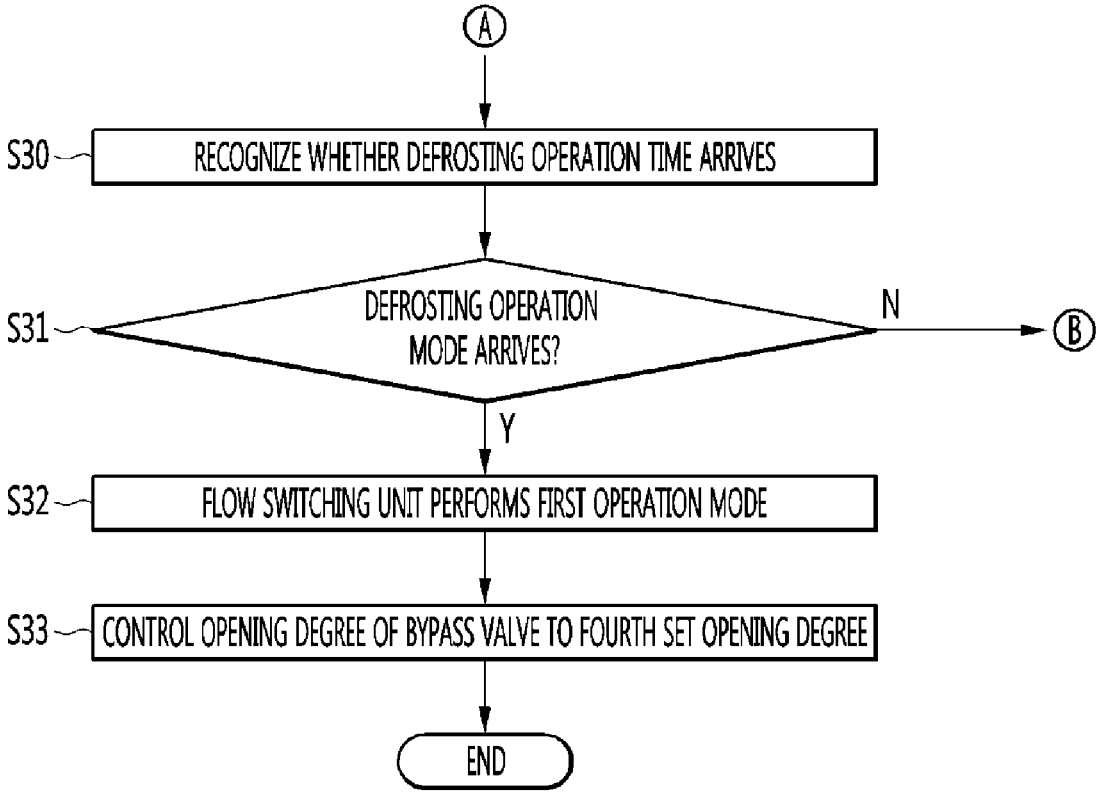
Figure 9:
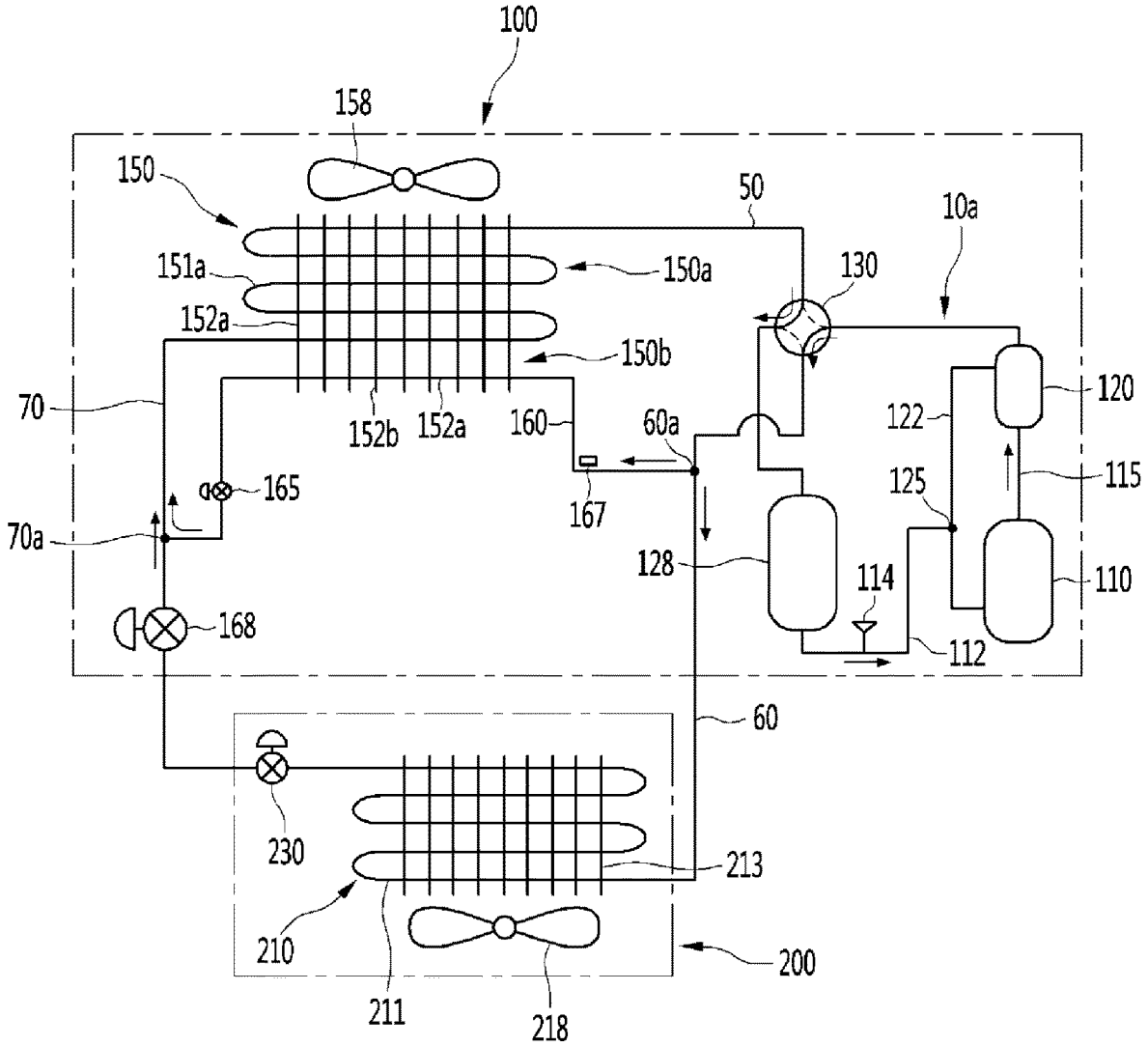
FIG. 9 is a diagram showing flow of refrigerant during a heating operation of an air conditioner according to an embodiment of the present invention.

FIGS. 7 and 8 are flowcharts illustrating a method of controlling an air conditioner during a heating operation according to an embodiment of the present invention, and FIG. 9 is a diagram showing flow of refrigerant during a heating operation of an air conditioner according to an embodiment of the present invention.

Referring to FIGS. 7 to 9, a control method during a heating operation of an air conditioner of the present invention and flow of refrigerant will be described.

When a heating operation command of the air conditioner 10 is input through the input unit 11, the air conditioner 10 starts the heating operation mode (S21).

The flow switching unit 130 performs a second operation mode (S22). By performing the second operation mode of the flow switching unit 130, refrigerant compressed in the compressor 110 and passing through the oil separator 120 flows from the flow switching unit 130 to the second guide pipe 60.

The bypass valve 165 is opened at a first set opening degree (S123). As the bypass valve 165 is opened, some of the refrigerant of the second guide pipe 60 is introduced into the bypass flow passage 160 through the first branch part 60*a* and the remaining refrigerant flows into the indoor unit 200. The refrigerant of the bypass flow passage 160 passes through the second heat exchanging part 150*b* of the outdoor heat exchanger 150 and flows into the second branch part 70*a* of the third guide pipe 70.

At this time, the operation load of the compressor 110, that is, the first information of a driving frequency, is sensed through the compressor load sensing unit 15. In addition, the operation load of the indoor unit 200, that is, the second information of a cooling load, is sensed through the indoor-unit load sensing unit 16. By such sensing operation, the controller 20 may recognize a difference between operation capacity of the compressor 110 and capacity required by the indoor unit 200 (S24 and S25).

Based on the first and second information, the opening degree of the bypass valve 165 may be controlled to a second set opening degree. As described in the cooling operation, if the difference between the first and second information is large, that is, if the operation load of the compressor 110 is greater than that of the indoor unit 200 by a set value or more, control may be performed to increase the opening degree of the bypass valve 165. In contrast, if the difference between the first and second information is equal to or less than the set value, control may be performed to maintain or decrease the opening degree of the bypass valve 165. For example, if the opening degree of the bypass valve 165 is maintained, the first set opening degree and the second set opening degree may be equal.

According to such control, a balance between capacity of the compressor 110 and the load of the indoor unit 200 is achieved, thereby performing continuous heating operation of the air conditioner 10 and preventing the compressor from being frequently turned on/off (S26).

The temperature and humidity of outdoor air are sensed through the outdoor air temperature sensor 13 and the outdoor air humidity sensor 14. The lower the temperature of the outdoor air and the higher the humidity of the outdoor air, the higher the possibility of freezing occurring in the lower portion of the outdoor unit 100 or in the lower portion of the outdoor heat exchanger 150. That is, due to high humidity, there is a high possibility that defrost water is generated on the surface of the outdoor heat exchanger 150. The defrost water may be collected in the lower portion of the outdoor heat exchanger 150. In addition, the possibility that the defrost water is frozen due to the low temperature of outdoor air is increased (S27).

Whether the outdoor air temperature is equal to or less than a set temperature and the outdoor air humidity is equal to or greater than set humidity is recognized (S28). Upon sensing that the outdoor air temperature is equal to or less than the set temperature and the outdoor air humidity is equal to or greater than the set humidity, it is recognized that the possibility that freezing occurs in the outdoor unit 10 is high and thus the opening degree of the bypass valve 165 may be controlled to a third set opening degree.

The third set opening degree is understood as an opening degree less than the second set opening degree. Specifically, if the outdoor air temperature and the outdoor air humidity fall within the above-described range, it may be recognized that the heating load of the air conditioner 10 is large. Accordingly, if the opening degree of the bypass valve 165 is too large, the amount of bypass refrigerant passing through the bypass flow passage 165 may be increased and thus heating capacity of the air conditioner 10 may be decreased.

Accordingly, the opening degree of the bypass valve 165 is controlled to be somewhat small so that the heating capacity can be prevented from being decreased. However, since the refrigerant having a high temperature, which is discharged from the compressor 110 through the bypass flow passage 160, may pass through the second heat exchanging part 150*b* of the outdoor heat exchanger 150, it is possible to prevent a phenomenon that freezing occurs in the lower portion of the outdoor unit 100 or in the lower portion of the outdoor heat exchanger 150.

At this time, since bypass refrigerant flows in the second heat exchanging part 150*b*, the amount of heat of evaporation may be decreased. However, since the outdoor fan 158 is disposed above the outdoor heat exchanger 150 and the amount of heat exchange is relatively large at the upper side of the outdoor heat exchanger 150 by driving the outdoor fan 158, decrease in amount of heat of evaporation may not be a serious concern.

In contrast, if the outdoor air temperature and the outdoor air humidity do not fall within the above-described range in step S28, step S26 and subsequent steps may be performed (S29).

Meanwhile, the refrigerant introduced into the indoor unit 200 through the second guide pipe 60 is condensed while passing through the indoor heat exchanger 210 and is introduced into the third guide pipe 70. The refrigerant introduced into the third guide pipe 70 may be depressurized in the main expansion device 168.

The refrigerant flowing in the bypass flow passage 160 is depressurized while passing through the bypass valve 165 and is combined with the refrigerant of the third guide pipe 70 in the second branch part 70*a*.

The combined refrigerant is introduced into the first heat exchanging part 150*a* of the outdoor heat exchanger 150 to evaporate and is introduced into the flow switching unit 130 through the first guide pipe 50. The refrigerant is introduced from the flow switching unit 130 to the gas-liquid separator 128 and is separated into gas-phase refrigerant and liquid-phase refrigerant in the gas-liquid separator 128. The separated gas-phase refrigerant may be sucked and compressed in the compressor 110 through the suction pipe 112.

When the air conditioner 10 performs the heating operation, a defrosting operation of the outdoor heat exchanger 150 may be performed. The defrosting operation may be performed with a predetermined period during the heating operation. Whether a defrosting operation time arrives or not is recognized (S30).

When the defrosting operation time arrives, the refrigeration cycle described with reference to FIG. 6 may be performed. That is, the flow switching unit 130 performs a first operation mode and thus the refrigerant discharged from the compressor 110 may be introduced from the flow switching unit 130 into the first heat exchanging part 150*a* of the outdoor heat exchanger 150. In order to prevent cold air from being supplied to the indoor space during the defrosting operation, the indoor fan 218 may be turned off and the heating operation may be stopped (S31 and S32).

The opening degree of the bypass valve 165 may be controlled to a fourth set opening degree. The fourth set opening degree may be greater than the third set opening degree and may be equal to or greater than the second set opening degree. For example, the fourth set opening degree may be a maximum opening degree of the bypass valve 165.

Although the opening degree of the bypass valve 165 is controlled to the fourth set opening degree, since the heating operation is stopped, the heating operation may not deteriorate.

Since the bypass valve 165 may be opened such that at least some of the refrigerant of the third guide pipe 70 is bypassed to the bypass flow passage 160, it is possible to prevent accumulated freezing in the second heat exchanging part 150*b* of the outdoor heat exchanger 150. Meanwhile, when the defrosting operation time does not arrive, step S27 and subsequent steps may be performed (S33).

As described above, since at least some of the refrigerant discharged from the compressor 110 or the refrigerant passing through the first heat exchanging part 150*a* of the outdoor exchanger 150 may be bypassed, it is possible to prevent non-continuous operation of the air conditioner 10 due to a difference between the load of the compressor 110 and the load of the indoor unit 200 during the heating or cooling operation of the air conditioner 10.

Since the refrigerant may be bypassed to the lower portion of the outdoor heat exchanger 150 during the heating operation of the air conditioner 10, it is possible to prevent accumulated freezing in the lower portion of the outdoor heat exchanger 150 or in the lower portion of the outdoor unit 100.

According to the embodiments of the present invention, when it is recognized that the load of the compressor is relatively greater than that of the indoor unit, since at least some of the refrigerant to be introduced into the indoor unit may be bypassed to the suction side of the compressor, balance between the load of the compressor and the load of the indoor unit can be achieved and thus a refrigeration cycle can be stably performed. Accordingly, industrial applicability is remarkable.

The invention claimed is:

1. An air conditioner, comprising:

a compressor that compresses refrigerant;

a flow switch provided at an outlet side of the compressor;

a first guide pipe that extends from the flow switch to an outdoor heat exchanger;

a second guide pipe that extends from the flow switch to an indoor unit;

a third guide pipe that extends from the outdoor heat exchanger to the indoor unit;

a bypass flow passage that extends from the second guide pipe to the third guide pipe such that at least a portion of the refrigerant in the second guide pipe is bypassed to the third guide pipe or at least a portion of the refrigerant in the third guide pipe is bypassed to the second guide pipe; and a bypass valve installed in the bypass flow passage to adjust an amount of refrigerant flowing through the bypass flow passage, wherein an upper portion of the outdoor heat exchanger connects the first guide pipe and the third guide pipe and a lower portion of the outdoor heat exchanger forms a portion of the bypass flow passage.

2. The air conditioner according to claim 1, further comprising:

a compressor load sensor that senses a load of the compressor; and an indoor-unit load sensor that senses a load of the indoor unit.

3. The air conditioner according to claim 2, wherein an opening degree of the bypass valve is adjusted via a controller based on a first set of information sensed by the compressor load sensor and a second set of information sensed by the indoor-unit load sensor.

4. The air conditioner according to claim 1, further comprising an outdoor fan provided at an upper side of the outdoor heat exchanger to allow outdoor air to flow to the outdoor heat exchanger.

5. The air conditioner according to claim 1, further comprising:

a bypass temperature sensor provided in the bypass flow passage to sense a temperature of refrigerant passing through the bypass flow passage; and a low-pressure sensor that senses low pressure of refrigerant suctioned into the compressor.

6. The air conditioner according to claim 5, wherein an opening degree of the bypass valve is adjusted via a controller based on a degree of superheat recognized based on information sensed by the bypass temperature sensor and the low-pressure sensor.

7. The air conditioner according to claim 1, further comprising:

a main expansion device installed in the third guide pipe; and an indoor expansion device installed in the indoor unit.

8. The air conditioner according to claim 1, wherein, during a cooling operation of the air conditioner, when the flow switch performs a first operation mode, the bypass valve is opened via a controller at a predetermined opening degree, such that refrigerant passing through the upper portion of the outdoor heat exchanger flows to the lower portion of the outdoor heat exchanger.

9. The air conditioner according to claim 8, wherein, during a heating operation of the air conditioner, when the flow switch performs a second operation mode, the bypass valve is opened via a controller at a predetermined opening degree, such that at least a portion of refrigerant of the second guide pipe flows to the lower portion of the outdoor heat exchanger.

10. The air conditioner according to claim 1, wherein the upper portion of the outdoor heat exchanger includes a first heat exchanging pipe and a first fin coupled to the first heat exchanging pipe and the lower portion of the outdoor heat exchanger includes a second heat exchanging pipe and a second fin coupled to the second heat exchanging pipe, and wherein a length of the first heat exchanging pipe and the first fin is greater than a length of the second heat exchanging pipe and the second fin.

11. A method of controlling an air conditioner, the method comprising:

driving a compressor to perform a cooling operation or a heating operation;

enabling refrigerant to flow to an outdoor heat exchanger or an indoor unit according to an operation mode of a flow switch installed at an outlet side of the compressor;

controlling an opening degree of a bypass valve such that at least a portion of refrigerant passing through an upper portion of the outdoor heat exchanger or refrigerant to be introduced into the indoor unit flows to a bypass flow passage; and sensing an operation load of the compressor and an operation load of the indoor unit to adjust the opening degree of the bypass valve, wherein the bypass flow passage extends from a second guide pipe extending from the flow switch to the indoor unit to a third guide pipe extending from the outdoor heat exchanger to the indoor unit, wherein the upper portion of the outdoor heat exchanger connects the first guide pipe and the third guide pipe and a lower portion of the outdoor heat exchanger forms a portion of the bypass flow passage.

12. The method according to claim 11, wherein, when the operation load of the compressor is greater than the operation load of the indoor unit by a predetermined value, the opening degree of the bypass valve is increased, and wherein, when a difference between the operation load of the compressor and the operation load of the indoor unit is equal to or less than the predetermined value, the opening degree of the bypass valve is maintained or decreased.

13. The method according to claim 11, further comprising, during a cooling operation of the air conditioner, sensing a temperature of refrigerant passing through the bypass flow passage and low pressure of refrigerant suctioned into the compressor to recognize a degree of superheat of refrigerant passing through the bypass flow passage.

14. The method according to claim 13, wherein, when the degree of superheat is lower than a target degree of superheat, the opening degree of the bypass valve is decreased, and wherein, when the degree of superheat is higher than the target degree of superheat, the opening degree of the bypass valve is increased.

15. The method according to claim 11, further comprising, during a heating operation of the air conditioner, sensing an outdoor air temperature and outdoor air humidity to adjust the opening degree of the bypass valve.

* * * * *